US011754082B2

(12) United States Patent
Yonemura et al.

(10) Patent No.: US 11,754,082 B2
(45) Date of Patent: Sep. 12, 2023

(54) CENTRIFUGAL COMPRESSOR

(71) Applicant: IHI Corporation, Tokyo (JP)

(72) Inventors: Atsushi Yonemura, Tokyo (JP); Ryota Sakisaka, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/818,019

(22) Filed: Aug. 8, 2022

(65) Prior Publication Data

US 2022/0381255 A1 Dec. 1, 2022

Related U.S. Application Data

(63) Continuation of application No. PCT/JP2021/005340, filed on Feb. 12, 2021.

(30) Foreign Application Priority Data

May 19, 2020 (JP) ..... 2020-087638

(51) Int. Cl.

| | |
|---|---|
| ***F04D 29/46*** | (2006.01) |
| ***F04D 17/10*** | (2006.01) |
| ***F04D 29/42*** | (2006.01) |
| ***F04D 27/00*** | (2006.01) |
| ***F02D 23/00*** | (2006.01) |
| *F02B 33/40* | (2006.01) |

(52) U.S. Cl.

CPC ..... *F04D 27/003* (2013.01); *F02D 23/00* (2013.01); *F04D 17/10* (2013.01)

(58) Field of Classification Search

CPC .... F04D 27/003; F04D 17/10; F04D 27/0246; F04D 27/0253; F04D 29/4213; F02D 23/00; F05D 2220/40

USPC ..... 415/151

See application file for complete search history.

(56) References Cited

U.S. PATENT DOCUMENTS 2,117,944 A * 5/1938 Cochrane ..... F23D 14/64 251/300
2,649,272 A * 8/1953 Barbato ..... F16K 3/03 138/45
4,122,668 A * 10/1978 Chou ..... F01D 21/006 188/290

(Continued)

FOREIGN PATENT DOCUMENTS

EP 3 530 954 A1 8/2019
JP 55-055606 U 4/1980

(Continued)

OTHER PUBLICATIONS

International Search Report dated Apr. 20, 2021 in PCT/JP2021/005340 filed on Feb. 12, 2021, 5 pages (with English Translation).

*Primary Examiner* — J. Todd Newton
(74) *Attorney, Agent, or Firm* — Oblon, McClelland, Maier & Neustadt, L.L.P.

(57) ABSTRACT

A centrifugal compressor includes: an impeller provided in a housing; a throttling portion provided in front of the impeller in the housing; an actuator rod connected to an actuator and including a plate portion including a plane at its end; and a connecting portion connected to the throttling portion and including a pair of projections facing each other across the plate portion in an axial direction of the actuator rod.

6 Claims, 11 Drawing Sheets

(56) References Cited

U.S. PATENT DOCUMENTS

| | | | | |
|---|---|---|---|---|
| 4,532,961 | A * | 8/1985 | Walton | F16K 47/045 251/212 |
| 10,947,893 | B2 * | 3/2021 | Kuenstner | F02B 33/40 |
| 11,131,236 | B2 * | 9/2021 | Lombard | F04D 29/4206 |
| 11,255,256 | B2 * | 2/2022 | Ganser | F02C 6/12 |
| 2016/0177956 | A1 * | 6/2016 | Mohtar | F04D 27/0253 417/406 |
| 2017/0298943 | A1 * | 10/2017 | Mohtar | F04D 29/464 |
| 2017/0298953 | A1 * | 10/2017 | Lombard | F04D 29/464 |
| 2017/0320470 | A1 * | 11/2017 | Belanger | F04D 29/464 |
| 2019/0048876 | A1 * | 2/2019 | Mohtar | F04D 27/0207 |
| 2019/0136755 | A1 * | 5/2019 | Lombard | F02C 6/12 |
| 2019/0178151 | A1 * | 6/2019 | Smith | F04D 27/0253 |
| 2019/0264604 | A1 * | 8/2019 | Lombard | F04D 29/464 |
| 2019/0264710 | A1 * | 8/2019 | Mohtar | F04D 29/464 |
| 2019/0271329 | A1 * | 9/2019 | Mohtar | F04D 29/464 |
| 2021/0088054 | A1 * | 3/2021 | Sakisaka | F02B 33/40 |

FOREIGN PATENT DOCUMENTS

| | | | |
|---|---|---|---|
| JP | 58-185999 | A | 10/1983 |
| JP | 61-102334 | U | 6/1986 |
| JP | 2004-066307 | A | 3/2004 |
| WO | WO 2020/031507 | A1 | 2/2020 |

* cited by examiner

CENTRIFUGAL COMPRESSOR

CROSS REFERENCE TO RELATED APPLICATIONS

This application is a continuation application of International Application No. PCT/JP2021/005340, filed on Feb. 12, 2021, which claims priority to Japanese Patent Application No. 2020-087638 filed on May 19, 2020, the entire contents of which are incorporated herein by reference.

BACKGROUND ART

Technical Field

The present disclosure relates to a centrifugal compressor.

A centrifugal compressor includes a compressor housing. An intake flow path is formed in the compressor housing. A compressor impeller is arranged in the intake flow path. When a flow rate of air flowing into the compressor impeller decreases, the air compressed by the compressor impeller flows backward in the intake flow path, causing a phenomenon known as surging.

Patent Literatures 1 and 2 disclose a centrifugal compressor including a throttling mechanism in a compressor housing. The throttling mechanism protrudes a throttling portion into an intake flow path. The throttling portion narrows the intake flow path. By narrowing the intake flow path, surging is curbed.

CITATION LIST

Patent Literature

Patent Literature 1: EP 3530954 A
Patent Literature 2: WO 2020/031507 A

SUMMARY

Technical Problem

The throttling mechanism of the Patent Literatures 1 and 2 includes a plurality of throttling portions, a connecting portion, an actuator rod, and an actuator. The actuator rod is connected to the actuator. The actuator moves the actuator rod in an axial direction. The connecting portion connects the actuator rod to the plurality of throttling portions. When the actuator rod moves in the axial direction, the connecting portion moves the plurality of throttling portions between a protruding position protruding into the intake flow path, and a retracted position retracted from the intake flow path.

A single depression (or through hole) depressed radially inward is formed on an outer surface of the actuator rod. A single protrusion inserted into the depression (or through hole) is formed on the connecting portion. When the actuator rod moves, a force is applied from the depression (or through hole) of the actuator rod to the single protrusion of the connecting portion, causing a stress concentration.

As such, in the throttling mechanism of Patent Literatures 1 and 2, the stress concentration occurs at the single protrusion of the connecting portion, when the actuator rod moves. The stress concentration at the single protrusion may cause a decrease in durability of the connecting portion.

The present disclosure aims to provide a centrifugal compressor that can reduce a stress concentration occurring at a connecting portion.

Solution to Problem

To solve the above problem, a centrifugal compressor according to an aspect of the present disclosure includes: an impeller provided in a housing; a throttling portion provided in front of the impeller in the housing; an actuator rod connected to an actuator and including a plate portion including a plane at its end; and a connecting portion connected to the throttling portion and including a pair of projections facing each other across the plate portion in an axial direction of the actuator rod.

Projecting heights of side surfaces closer to each other of the pair of projections may be lower than projecting heights of side surfaces spaced apart from each other of the pair of projections.

A groove having a U-shape in a cross-section along the axial direction of the actuator rod may be provided between the pair of projections.

The plate portion may have a circular shape in a cross-section perpendicular to the axial direction of the actuator rod.

The plate portion may contain a material that is harder than a material of areas other than the plate portion in the actuator rod.

The actuator rod may be attached to the actuator by double nuts.

Effects of Disclosure

According to the present disclosure, the stress concentration occurring at the connecting portion can be reduced.

DESCRIPTION OF EMBODIMENTS

An embodiment of the present disclosure will be described in detail below with reference to the accompanying drawings. Specific dimensions, materials, and numerical values described in the embodiment are merely examples for a better understanding, and do not limit the present disclosure unless otherwise specified. In this specification and the drawings, duplicate explanations are omitted for elements having substantially the same functions and configurations by assigning the same sign. Furthermore, elements not directly related to the present disclosure are omitted from the figures.

Figure 1:
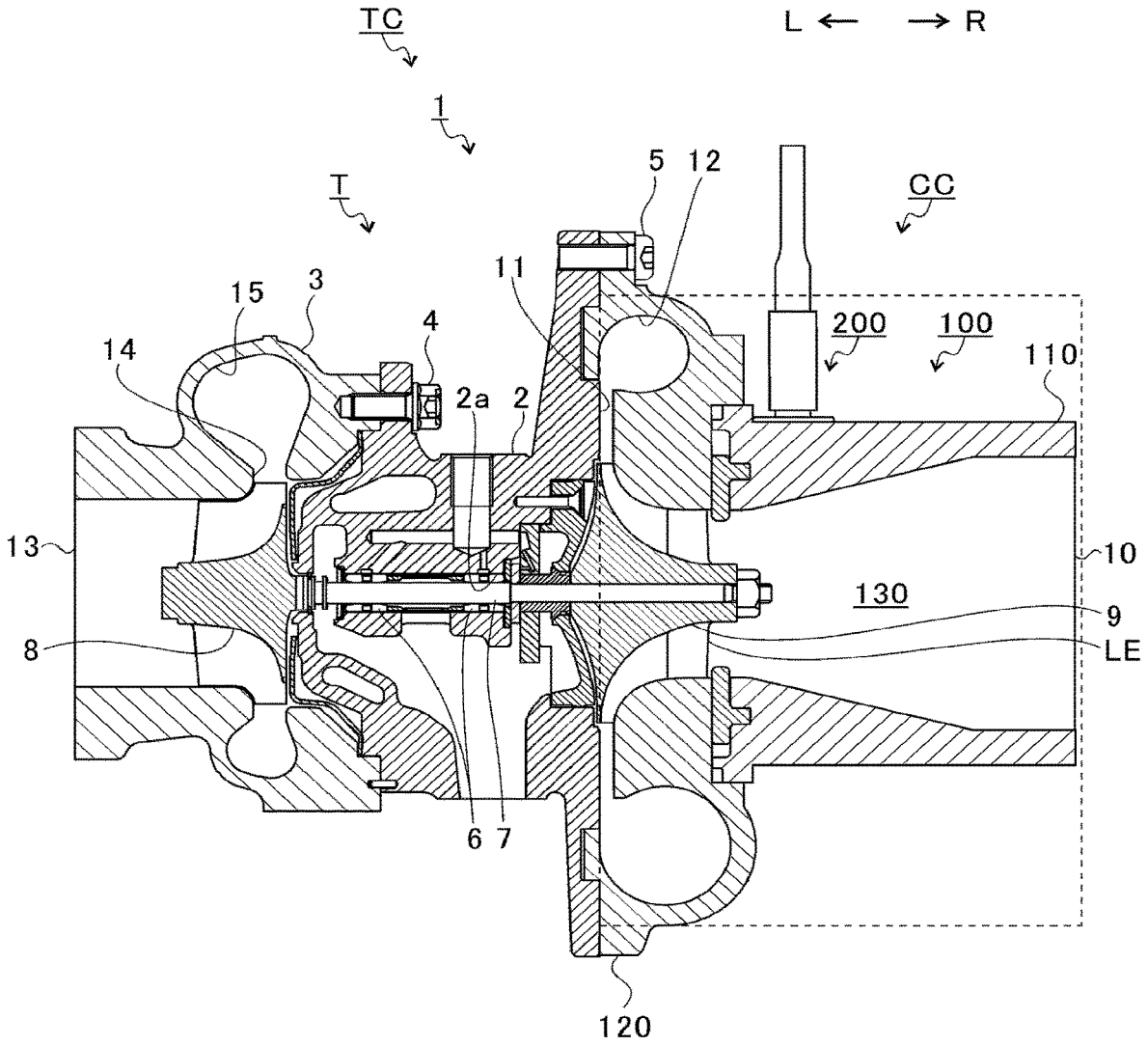
FIG. 1 is a schematic cross-sectional view of a turbocharger.

FIG. 1 is a schematic cross-sectional view of a turbocharger TC. A direction indicated by arrow L in FIG. 1 is described as the left side of the turbocharger TC. A direction indicated by arrow R in FIG. 1 is described as the right side of the turbocharger TC. As shown in FIG. 1, the turbocharger TC comprises a turbocharger body 1. The turbocharger body 1 includes a bearing housing 2, a turbine housing 3, and a compressor housing (housing) 100. The turbine housing 3 is connected to the left side of the bearing housing 2 by a fastening bolt 4. The compressor housing 100 is connected to the right side of the bearing housing 2 by a fastening bolt 5.

An accommodation hole 2*a* is formed in the bearing housing 2. The accommodation hole 2*a* passes through in the left-to-right direction of the turbocharger TC. A bearing 6 is arranged in the accommodation hole 2*a*. In FIG. 1, a full floating bearing is shown as an example of the bearing 6. However, the bearing 6 may be any other radial bearing, such as a semi-floating bearing or a rolling bearing. A portion of a shaft 7 is arranged in the accommodation hole 2*a*. The shaft 7 is rotatably supported by the bearing 6. A turbine impeller 8 is provided at the left end of the shaft 7. The turbine impeller 8 is rotatably housed in the turbine housing 3. A compressor impeller (impeller) 9 is provided at the right end of shaft 7. The compressor impeller 9 is rotatably housed in the compressor housing 100.

An inlet 10 is formed in the compressor housing 100. The inlet 10 opens to the right side of the turbocharger TC. The inlet 10 is connected to an air cleaner (not shown). Air flows into the inlet 10 from the air cleaner (not shown). A diffuser flow path 11 is formed between the bearing housing 2 and the compressor housing 100. The diffuser flow path 11 pressurizes the air. The diffuser flow path 11 is formed in an annular shape from an inner side to an outer side in a radial direction of the shaft 7 (compressor impeller 9) (hereinafter simply referred to as the radial direction). A radially inner part of the diffuser flow path 11 is connected to the inlet 10 through the compressor impeller 9.

A compressor scroll flow path 12 is formed in the compressor housing 100. The compressor scroll flow path 12 is formed in an annular shape. The compressor scroll flow path 12 is formed radially outside the compressor impeller 9. The compressor scroll flow path 12 is located, for example, radially outside the diffuser flow path 11. The compressor scroll flow path 12 is connected to an intake port of an engine (not shown) and to the diffuser flow path 11. When the compressor impeller 9 rotates, air is sucked from the inlet 10 into the compressor housing 100. The intake air is pressurized and accelerated while passing through blades of the compressor impeller 9. The pressurized and accelerated air is further pressurized in the diffuser flow path 11 and the compressor scroll flow path 12. The pressurized air flows out of a discharge port (not shown) and is directed to the intake port of the engine.

An outlet 13, a connecting flow path 14, and a turbine scroll flow path 15 are formed in the turbine housing 3. The outlet 13 opens to the left side of the turbocharger TC. The outlet 13 is connected to an exhaust gas purifier (not shown). The connecting flow path 14 is located between the turbine impeller 8 and the turbine scroll flow path 15. The turbine scroll flow path 15 is located, for example, radially outside the connecting flow path 14.

The turbine scroll flow path 15 is connected to a gas inlet (not shown). Exhaust gas discharged from an exhaust manifold of the engine (not shown) is led to the gas inlet. The connecting flow path 14 connects the turbine scroll flow path 15 to the outlet 13 via the turbine impeller 8. The exhaust gas led from the gas inlet to the turbine scroll flow path 15 is directed to the outlet 13 through the connecting flow path 14 and blades of the turbine impeller 8. The exhaust gas rotates the turbine impeller 8 while passing therethrough.

A rotational force of the turbine impeller 8 is transmitted to the compressor impeller 9 via the shaft 7. As described above, the air is pressurized by the rotational force of the compressor impeller 9, and directed to the intake port of the engine.

The turbocharger TC of the present embodiment includes a turbine T and a centrifugal compressor (compressor) CC. The turbine T includes the bearing housing 2, the bearing 6, the shaft 7, the turbine housing 3, and the turbine impeller 8. The centrifugal compressor CC includes the bearing housing 2, the bearing 6, the shaft 7, the compressor housing 100, and the compressor impeller 9. In the present embodiment, the centrifugal compressor CC is described as being driven by the turbine impeller 8. However, the centrifugal compressor CC is not limited thereto, and may be driven by an unshown engine or by an unshown electric motor. As such, the centrifugal compressor CC of the present embodiment may be incorporated into a device other than the turbocharger TC, or may be a stand-alone unit.

Figure 2:
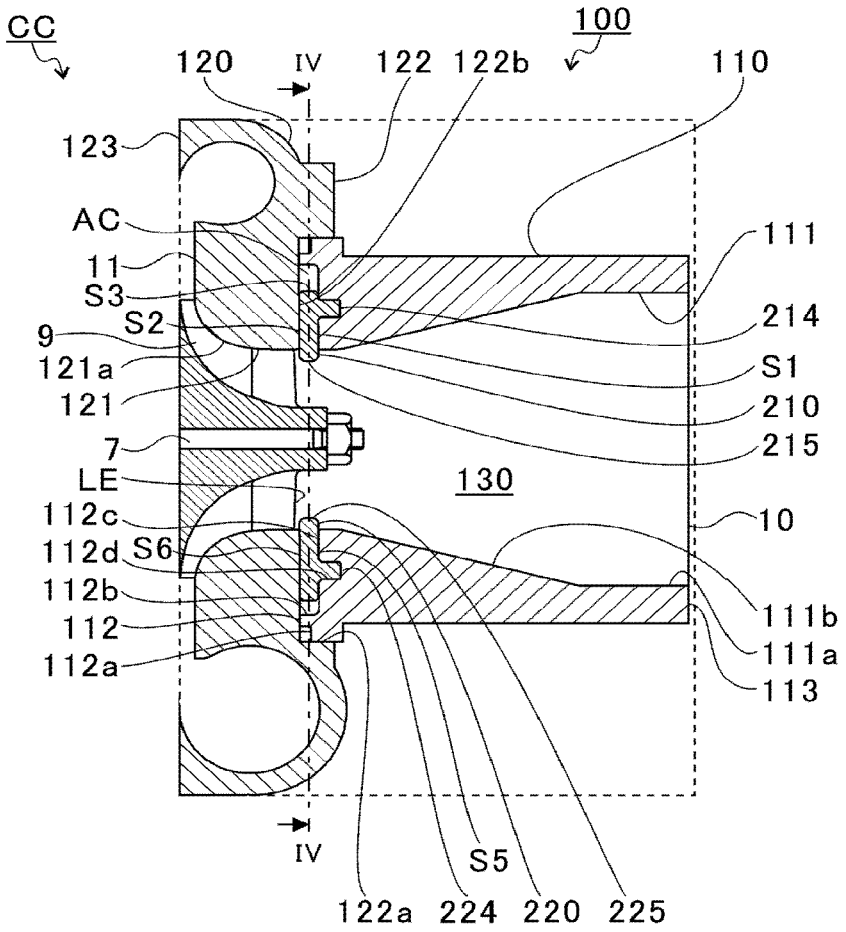
FIG. 2 is an extract of an area enclosed by dashed lines in FIG. 1.

FIG. 2 is an extract of an area enclosed by dashed lines in FIG. 1. As shown in FIG. 2, the compressor housing 100 includes a first housing portion 110 and a second housing portion 120. The first housing portion 110 is located on a side spaced apart from the bearing housing 2 (right side in FIG. 2) with respect to the second housing portion 120. The second housing portion 120 is connected to the bearing housing 2. The first housing portion 110 is connected to the second housing portion 120 at a side opposite to the bearing housing 2.

The first housing portion 110 has a substantially cylindrical shape. A through hole 111, an end face 112, and an end face 113 are formed in the first housing portion 110. The through hole 111 extends from the end face 112 to the end face 113 along the rotational axis direction of the shaft 7 (compressor impeller 9) (hereinafter simply referred to as the rotational axis direction). In other words, the through hole 111 passes through the housing portion 110 in the rotational axis direction. The through hole 111 includes the inlet 10 at the end face 113.

The through hole 111 includes a parallel portion 111*a* and a tapered portion 111*b*. The parallel portion 111*a* is located closer to the end face 113 with respect to the tapered portion 111*b*. An inner diameter of the parallel portion 111*a* is substantially constant over the rotational axis direction. The tapered portion 111*b* is located closer to the end face 112 with respect to the parallel portion 111*a*. The tapered portion 111*b* is continuous with the parallel portion 111*a*. An inner diameter of the tapered portion 111*b* at a position continuous with the parallel portion 111*a* is substantially the same as the inner diameter of the parallel portion 111*a*. The inner diameter of the tapered portion 111*b* decreases as being spaced apart from the parallel portion 111*a* (as approaching the end face 112).

The end face 112 of the first housing portion 110 is adjacent (connected) to the second housing portion 120. The end face 112 is a plane that is substantially orthogonal to a rotational center axis of the shaft 7. The end face 113 of the first housing portion 110 is spaced apart from the second housing portion 120. The end face 113 is a plane that is substantially orthogonal to the rotational center axis of the shaft 7.

A notch 112*a* and an accommodation groove 112*b* are formed in the end face 112. The notch 112*a* is recessed from the end face 112 toward the end face 113. The notch 112*a* is formed at a periphery of the end face 112. The notch 112*a* has, for example, a substantially annular shape when seen from the rotational axis direction.

The accommodation groove 112*b* is formed radially inside the notch 112*a*. A radially inner part of the accommodation groove 112*b* is connected to the through hole 111. The accommodation groove 112*b* is recessed from the end face 112 toward the end face 113. The accommodation groove 112*b* has, for example, a substantially annular shape when seen from the rotational axis direction. The accommodation groove 112*b* includes a wall surface 112*c* on an end face 113 side. The wall surface 112*c* is a plane that is substantially orthogonal to the rotational center axis of the shaft 7.

Bearing holes 112*d* and an accommodation hole 112*e* (see FIG. 3) are formed in the wall surface 112*c*. The bearing holes 112*d* extend from the wall surface 112*c* toward the end face 113 in the rotational axis direction. Two bearing holes 112*d* are provided with being spaced apart from each other in a rotational direction of the shaft 7 (compressor impeller 9) (hereinafter simply referred to as the rotational direction or a circumferential direction). The two bearing holes 112*d* are arranged at positions spaced apart from each other by 180 degrees in the rotational direction. The accommodation hole 112*e* will be described later with reference to FIG. 3.

The accommodation groove 112*b*, the wall surface 112*c*, the bearing holes 112*d*, and the accommodation hole 112*e* define an accommodation chamber AC. The accommodation chamber AC is formed between the first housing portion 110 and the second housing portion 120. The accommodation chamber AC is formed closer to the inlet 10 with respect to a leading-edge LE of blades of the compressor impeller 9. The accommodation chamber AC accommodates a plurality of movable portions (first movable portion 210 and second movable portion 220) that will be described later.

A through hole 121, an end face 122, and an end face 123 are formed in the second housing portion 120. The through hole 121 extends from the end face 122 to the end face 123 along the rotational axis direction. In other words, the through hole 121 passes through the second housing portion 120 in the rotational axis direction. The through hole 121 is connected to the through hole 111 of the first housing portion 110.

An inner diameter of the through hole 121 at an end closer to the end face 122 is substantially equal to the inner diameter of the through hole 111 at an end closer to the end face 112. A shroud portion 121*a* is formed on an inner wall of the through hole 121. The shroud portion 121*a* radially faces the compressor impeller 9. An outer diameter of the compressor impeller 9 increases as being spaced apart from the leading-edge LE in the rotational axis direction. An inner diameter of the shroud portion 121*a* increases as moving from the end face 122 toward the end face 123.

The end face 122 of the second housing portion 120 is adjacent to the first housing portion 110. The end face 122 is a plane that is substantially orthogonal to the rotational center axis of the shaft 7. The end face 123 of the second housing portion 120 is spaced apart from the first housing portion 110 (connected to the bearing housing 2). The end face 123 is a plane that is substantially orthogonal to the rotational center axis of the shaft 7.

An accommodation groove 122*a* is formed in the end face 122. The accommodation groove 122*a* is recessed from the end face 122 toward the end face 123. The accommodation groove 122*a* has, for example, a substantially annular shape when seen from the rotational axis direction. The first housing portion 110 is inserted into the accommodation groove 122*a*. The accommodation groove 122*a* includes a wall surface 122*b* on an end face 123 side. The wall surface 122*b* is a plane that is substantially orthogonal to the rotational center axis of the shaft 7.

The wall surface 122*b* is in contact with the end face 112 of the first housing portion 110. In this state, the first housing portion 110 is connected to the second housing portion 120. The accommodation chamber AC is formed between the first housing portion 110 (wall surface 112*c*) and the second housing portion 120 (wall surface 122*b*).

The through hole 111 of the first housing portion 110 and the through hole 121 of the second housing portion form an intake flow path 130. In other words, the intake flow path 130 is formed in the compressor housing 100. The intake flow path 130 extends from the air cleaner (not shown) to the diffuser flow path 11 via the inlet 10. A part including the air cleaner (inlet 10) in the intake flow path 130 is an upstream side in a flow of the intake air, and a part including the diffuser flow path 11 in the intake flow path 130 is a downstream side in the flow of the intake air.

The compressor impeller 9 is arranged in the intake flow path 130. The intake flow path 130 (through holes 111 and 121) has, for example, a circular shape around the rotational axis of the compressor impeller 9 in a cross-section perpendicular to the rotational axis direction. However, the cross-sectional shape of the intake flow path 130 is not limited thereto, and may be, for example, an elliptical shape.

A seal (not shown) is placed in the notch 112*a* of the first housing portion 110. The seal prevents a flow of air passing through a gap between the first housing portion 110 and the second housing portion 120. However, the notch 112*a* and the seal are not essential.

Returning to FIG. 1, in the present embodiment, a link mechanism 200 is provided in the compressor housing 100. The link mechanism 200 is provided in the first housing portion 110. However, the link mechanism 200 is not limited thereto, and may be provided in the second housing portion 120.

Figure 3:
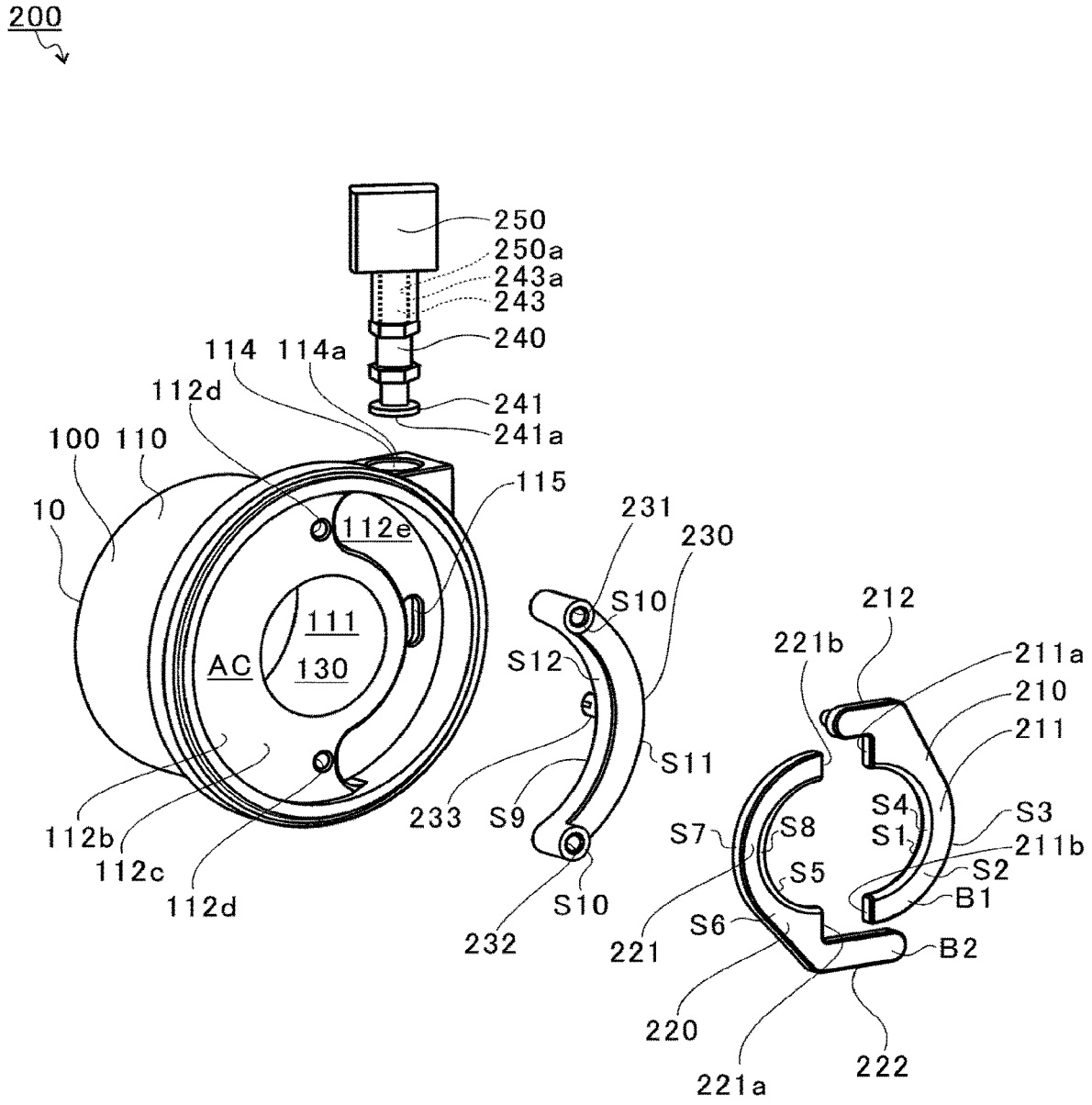
FIG. 3 is an exploded perspective view of components included in a link mechanism.

FIG. 3 is an exploded perspective view of components included in the link mechanism 200. In FIG. 3, the first housing portion 110 of the compressor housing 100 is only shown. As shown in FIG. 3, the link mechanism 200 includes a first movable portion 210, a second movable portion 220, a connecting portion 230, an actuator rod 240, and an actuator 250. The link mechanism 200 is located upstream of the compressor impeller 9 in the intake flow path 130 in the rotational axis direction.

The first movable portion 210 is arranged in the accommodation groove 112*b* (accommodation chamber AC). Specifically, the first movable portion 210 is located between the wall surface 112*c* of the accommodation groove 112*b* and the wall surface 122*b* of the accommodation groove 122*a* (see FIG. 2) in the rotational axis direction.

The first movable portion 210 includes an intake upstream surface S1, an intake downstream surface S2, a radial outer surface S3, and a radial inner surface S4. In the first movable portion 210, the intake upstream surface S1 is a surface on the upstream side in the flow of the intake air. In the first movable portion 210, the intake downstream surface S2 is a surface on the downstream side in the flow of the intake air. In the first movable portion 210, the radial outer surface S3 is a surface on a radially outer side. In the first movable portion 210, the radial inner surface S4 is a surface on a radially inner side.

The first movable portion 210 includes a body portion B1. The body portion B1 includes a curved portion 211 and an arm portion 212. The curved portion 211 extends in the circumferential direction of the compressor impeller 9. The curved portion 211 has a substantially semi-arcuate shape. In the curved portion 211, a first end face 211*a* and a second end face 211*b* in the circumferential direction extend parallel to the radial direction and the rotational axis direction. However, the first end face 211*a* and the second end face 211*b* may be inclined with respect to the radial direction and the rotational axis direction.

The arm portion 212 is provided closer to the first end face 211*a* of the curved portion 211. The arm portion 212 extends radially outward from the radial outer surface S3 of the curved portion 211. The arm portion 212 extends in a direction inclined with respect to the radial direction (toward the second movable portion 220).

The second movable portion 220 is arranged in the accommodation groove 112*b* (accommodation chamber AC). Specifically, the second movable portion 220 is located between the wall surface 112*c* of the accommodation groove 112*b* and the wall surface 122*b* of the accommodation groove 122*a* (see FIG. 2) in the rotational axis direction.

The second movable portion 220 includes an intake upstream surface S5, an intake downstream surface S6, a radial outer surface S7, and a radial inner surface S8. In the second movable portion 220, the intake upstream surface S5 is a surface on the upstream side in the flow of the intake air. In the second movable portion 220, the intake downstream surface S6 is a surface on the downstream side in the flow of the intake air. In the second movable portion 220, the radial outer surface S7 is a surface on a radially outer side. In the second movable portion 220, the radial inner surface S8 is a surface on a radially inner side.

The second movable portion 220 includes a body portion B2. The body portion B2 includes a curved portion 221 and an arm portion 222. The curved portion 221 extends in the circumferential direction of the compressor impeller 9. The curved portion 221 has a substantially semi-arcuate shape. In the curved portion 221, a first end face 221*a* and a second end face 221*b* in the circumferential direction extend parallel to the radial direction and the rotational axis direction. However, the first end face 221*a* and the second end face 221*b* may be inclined with respect to the radial direction and the rotational axis direction.

The arm portion 222 is provided closer to the first end face 221*a* of the curved portion 221. The arm portion 222 extends radially outward from the radial outer surface S7 of the curved portion 221. The arm portion 222 extends in a direction inclined to the radial direction (toward the first movable portion 210).

The curved portion 211 faces the curved portion 221 across the rotational center of the compressor impeller 9 (intake flow path 130). The first end face 211*a* of the curved portion 211 faces the second end face 221*b* of the curved portion 211 in the circumferential direction. The second end face 211*b* of the curved portion 211 faces the first end face 221*a* of the curved portion 221 in the circumferential direction. The first movable portion 210 and the second movable portion 220 are configured such that the curved portions 211 and 221 are movable in the radial direction, as described later in detail.

The connecting portion 230 connects the first movable portion 210 and the second movable portion 220 to the actuator rod 240. The connecting portion 230 is located closer to the inlet 10 with respect to the first movable portion 210 and the second movable portion 220. The connecting portion 230 has a substantially arc shape.

The connecting portion 230 includes an intake upstream surface S9, an intake downstream surface S10, a radial outer surface S11, and a radial inner surface S12. In the connecting portion 230, the intake upstream surface S9 is a surface on the upstream side in the flow of the intake air. In the connecting portion 230, the intake downstream surface S10 is a surface on the downstream side in the flow of the intake air. In the connecting portion 230, the radial outer surface S11 is a surface on a radially outer side. In the connecting portion 230, the radial inner surface S12 is a surface on a radially inner side.

The connecting portion 230 includes a first bearing hole 231 at one end in the circumferential direction, and a second bearing hole 232 on the other end. The first bearing hole 231 and the second bearing hole 232 are opened on the intake downstream surface S10. The first bearing hole 231 and the second bearing hole 232 are recessed from the intake downstream surface S10 along the rotational axis direction. In the present embodiment, the first bearing hole 231 and the second bearing hole 232 are a non-through hole. However, the first bearing hole 231 and the second bearing hole 232 may pass through the connecting portion 230 in the rotational axis direction.

The connecting portion 230 includes a shaft portion 233 between the first bearing hole 231 and the second bearing hole 232. The shaft portion 233 is formed on the intake upstream surface S9 of the connecting portion 230. The shaft portion 233 protrudes from the intake upstream surface S9 along the rotational axis direction. The shaft portion 233 has, for example, a rounded rectangular shape in a cross-section perpendicular to the central axis. However, the shaft portion 233 is not limited thereto, and may have, for example, a circular shape, an elliptical shape, or a rectangular shape in the cross-section perpendicular to the central axis. Details of the shaft portion 233 will be described later.

Figure 4:
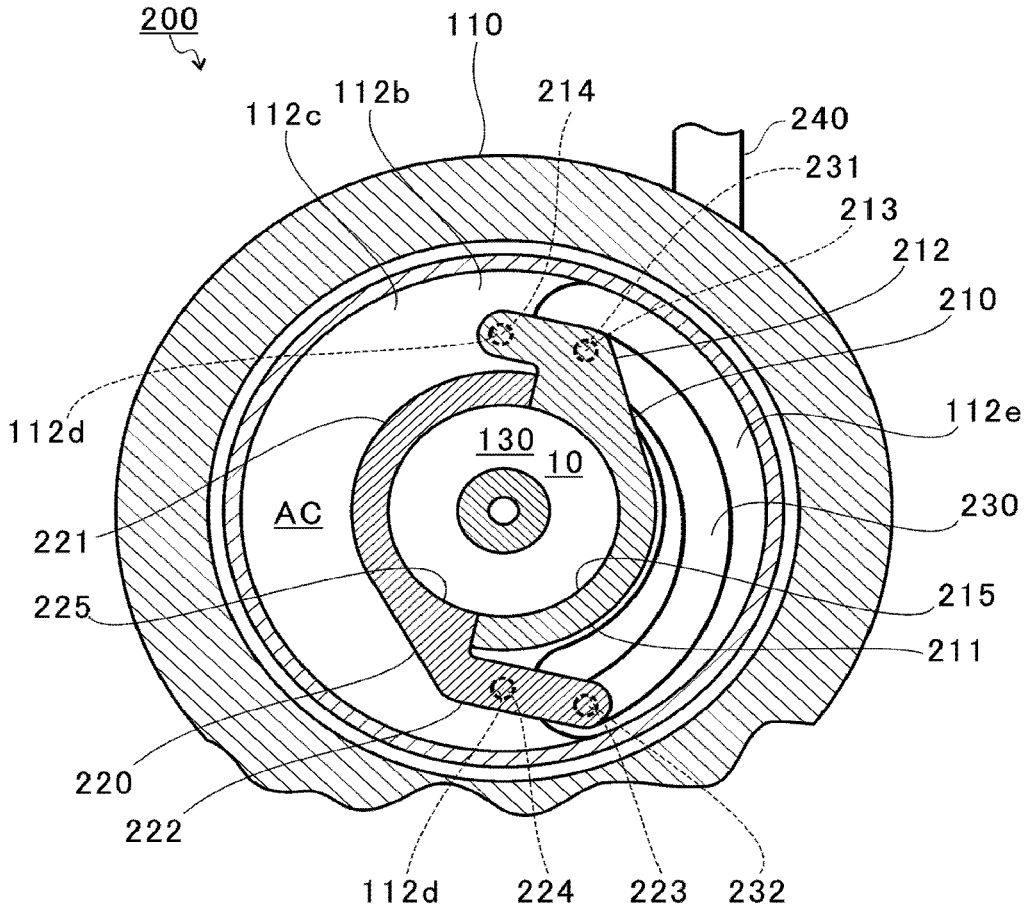
FIG. 4 is a cross-sectional view taken along IV-IV line in FIG. 2.

FIG. 4 is a cross-sectional view taken along IV-IV line in FIG. 2. As shown in dashed lines in FIG. 4, the first movable portion 210 includes a connecting shaft 213 and a rotational shaft 214. In the arm portion 212 of the first movable portion 210, the connecting shaft 213 and the rotational shaft 214 protrude from the intake upstream surface S1 facing the wall surface 112*c* in the rotational axis direction (see FIG. 2). In FIG. 4, the connecting shaft 213 and the rotational shaft 214 extend toward a back side of the paper. The rotational shaft 214 extends substantially parallel to the connecting shaft 213. The connecting shaft 213 and rotational shaft 214 have a cylindrical shape.

An outer diameter of the connecting shaft 213 is smaller than an inner diameter of the first bearing hole 231 of the connecting portion 230. The connecting shaft 213 is inserted into the first bearing hole 231. The connecting shaft 213 is rotatably supported by the first bearing hole 231. An outer diameter of the rotational shaft 214 is smaller than an inner diameter of the bearing hole 112*d* of the housing portion 110. The rotational shaft 214 is inserted into the vertically upper bearing hole 112*d* of the two bearing holes 112*d*. The rotational shaft 214 is rotatably supported by the bearing hole 112*d*.

The second movable portion 220 includes a connecting shaft 223 and a rotational shaft 224. In the arm portion 222 of the second movable portion 220, the connecting shaft 223 and the rotational shaft 224 protrude from the intake upstream surface S5 facing the wall surface 112*c* in the rotational axis direction (see FIG. 2). In FIG. 4, the connecting shaft 223 and the rotational shaft 224 extend toward the back side of the paper. The rotational shaft 224 extends substantially parallel to the connecting shaft 223. The connecting shaft 223 and rotational shaft 224 have a cylindrical shape.

An outer diameter of the connecting shaft 223 is smaller than an inner diameter of the second bearing hole 232 of the connecting portion 230. The connecting shaft 223 is inserted into the second bearing hole 232. The connecting shaft 223 is rotatably supported by the second bearing hole 232. An outer diameter of the rotational shaft 224 is smaller than an inner diameter of the bearing hole 112*d* of the housing portion 110. The rotational shaft 224 is inserted into the vertically lower bearing hole 112*d* of the two bearing holes 112*d*. The rotational shaft 224 is rotatably supported by the bearing hole 112*d*.

Returning to FIG. 3, the actuator rod 240 has a substantially cylindrical shape. The actuator rod 240 includes a plate portion 241 formed at one end, and a fastening portion 243 formed at the other end. The plate portion 241 is formed in a plate shape. In the plate portion 241, an end face opposite to the fastening portion 243 includes a plane 241*a* perpendicular to a central axis of the actuator rod 240. In other words, an end of the actuator rod 240 includes the plane 241*a* perpendicular to the central axis of the actuator rod 240.

The plate portion 241 of the present embodiment has a circular cross-section perpendicular to the central axis direction of the actuator rod 240. However, the cross-section of the plate portion 241 is not limited thereto, and may be rectangular, elliptical, or polygonal.

The fastening portion 243 is connected to the actuator 250. The fastening portion 243 includes, for example, a male thread 243*a*. A female thread 250*a* is formed in the actuator 250, for example. The male thread 243*a* of the fastening portion 243 is screwed into the female thread 250*a* of the actuator 250 to attach the actuator rod 240 to the actuator 250. For example, the actuator 250 with the actuator rod 240 is mounted on the compressor housing 100.

The actuator 250 is, for example, a linear actuator. However, the actuator 250 only needs to drive the actuator rod 240 in the axial direction, and may be configured as, for example, a motor or a hydraulic cylinder.

An insertion hole 114 is formed in the first housing portion 110. One end 114*a* of the insertion hole 114 opens to an outside of the first housing portion 110. The insertion hole 114 extends in, for example, the vertical direction. The insertion hole 114 is located radially outside the through hole 111 (intake flow path 130). The plate portion 241 of the actuator rod 240 is inserted into the insertion hole 114.

The accommodation hole 112*e* is recessed from the wall surface 112*c* toward the inlet 10. The accommodation hole 112*e* is located spaced apart from the inlet 10 (closer to the second housing 120) with respect to the insertion hole 114. The accommodation hole 112*e* has a substantially arc shape when seen from the rotational axis direction. The accommodation hole 112*e* extends longer than the connecting portion 230 in the circumferential direction. The accommodation hole 112*e* is spaced apart from the bearing holes 112*d* in the circumferential direction.

A connecting hole 115 is formed in the accommodation hole 112*e*. The connecting hole 115 connects the insertion hole 114 to the accommodation hole 112*e*. The connecting hole 115 is formed substantially in the middle of the accommodation hole 112*e* in the circumferential direction. The connecting hole 115 is, for example, an elongated hole extending substantially parallel to an extending direction of the insertion hole 114. The connecting hole 115 has a width in the longitudinal direction that is larger than the width in the lateral direction.

The connecting portion 230 is accommodated in the accommodation hole 112*e*. The accommodation hole 112*e* is longer in the circumferential direction and wider in the radial direction than the connecting portion 230. Therefore, the connecting portion 230 is allowed to move inside the accommodation hole 112*e* in a plane direction perpendicular to the rotational axis direction.

The shaft portion 233 is inserted into the insertion hole 114 through the connecting hole 115. The plate portion 241 of the actuator rod 240 is inserted into the insertion hole 114. The plate portion 241 faces the connecting hole 115 in the rotational axis direction of the compressor impeller 9. The shaft portion 233 engages with the plate portion 241. The engagement between the shaft portion 233 and the plate portion 241 will be described later with reference to FIG. 10. The engagement between the shaft portion 233 and the plate portion 241 allows the actuator rod 230 to be driven with the actuator rod 240. The first movable portion 210 and the second movable portion 220 are also driven with the connecting portion 230.

The first movable portion 210 and the second movable portion 220 are accommodated in the accommodation groove 112*b*. In other words, the first movable portion 210 and the second movable portion 220 are provided in front of (on the upstream side of) the compressor impeller 9. As such, the first movable portion 210, the second movable portion 220, and the connecting portion 230 are located in the accommodation chamber AC formed between the first housing portion 110 and the second housing portion 120.

As described above, the link mechanism 200 includes the first movable portion 210, the second movable portion 220, and the connecting portion 230. The first movable portion 210, the second movable portion 220, the first housing portion 110, and the connecting portion 230 includes four links (nodes). The first movable portion 210, the second movable portion 220, the first housing portion 110, and the connecting portion 230 form a four-bar linkage. The four-bar linkage has one degree of freedom, and the driven nodes are limited to a movement in one way (limited chain). The four-bar linkage allows easy control of the link mechanism 200.

Figure 5:
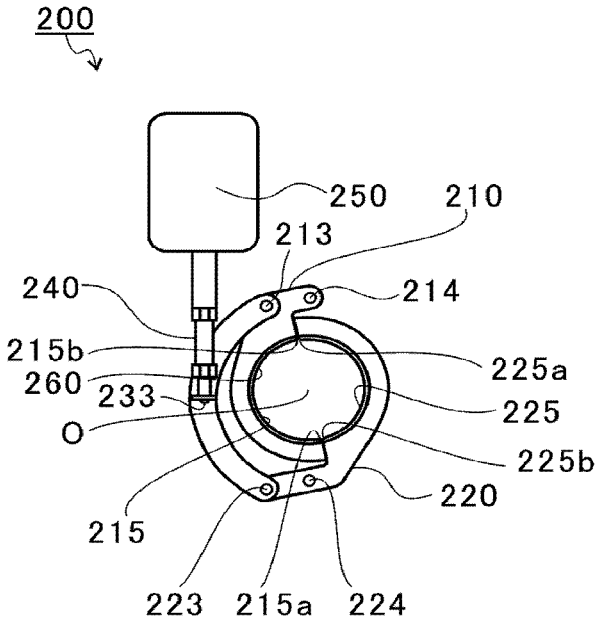
FIG. 5 is a first illustration of an operation of the link mechanism.

FIG. 5 is a first illustration of an operation of the link mechanism 200. In the following FIGS. 5, 6 and 7, the link mechanism 200 is seen from the inlet 10.

In the arrangement shown in FIG. 5, the first movable portion 210 and the second movable portion 220 are in contact with each other. In this state, as shown in FIGS. 2 and 4, a protrusion 215 that is a radially inner part of the first movable portion 210 protrudes (is exposed) into the intake flow path 130. A protrusion 225 that is a radially inner part of the second movable portion 220 protrudes (is exposed) into the intake flow path 130. The positions of the first movable portion 210 and the second movable portion 220 in this state is referred to as a protruding position (or throttling position).

As shown in FIG. 5, in the protruding position, circumferential ends 215*a* and 215*b* of the protrusion 215 and circumferential ends 225*a* and 225*b* of the protrusion 225 are in contact with each other. The protrusion 215 and the protrusion 225 form an annular hole 260. An inner diameter of the annular hole 260 is smaller than the inner diameter of the intake flow path 130 at a position where the protrusions 215 and 225 protrude. For example, the inner diameter of the annular hole 260 is smaller than the inner diameter of the intake flow path 130 at any positions.

Figure 6:
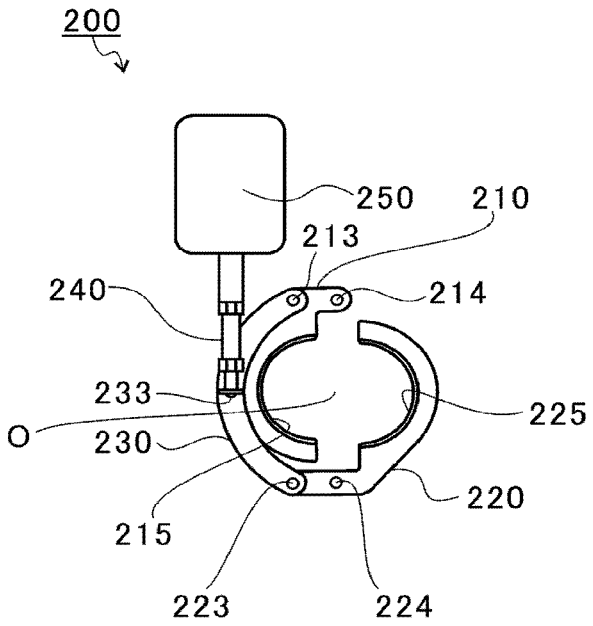
FIG. 6 is a second illustration of the operation of the link mechanism.
Figure 7:
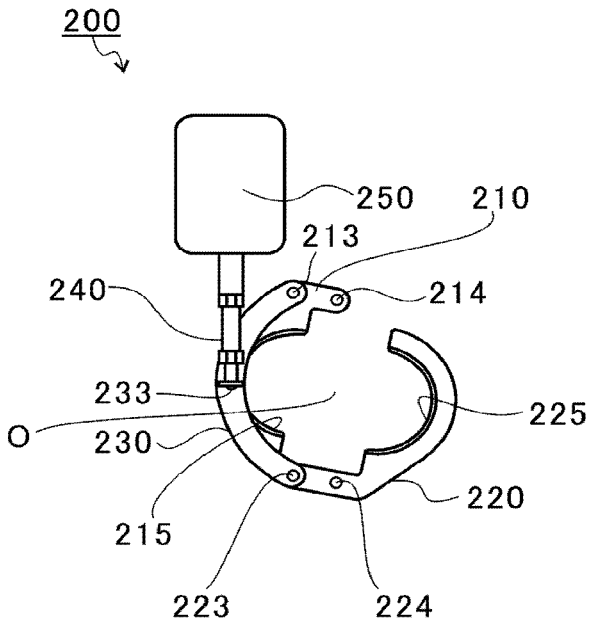
FIG. 7 is a third illustration of the operation of the link mechanism.

FIG. 6 is a second illustration of the operation of the link mechanism 200. FIG. 7 is a third illustration of the operation of the link mechanism 200. The actuator 250 linearly moves the actuator rod 240 in a direction intersecting the rotational axis direction of the compressor impeller 9 (up-and-down direction in FIGS. 6 and 7). The actuator 250 moves the actuator rod 240 in the central axis direction of the actuator rod 240. In FIGS. 6 and 7, the actuator rod 240 moves upward from the position shown in FIG. 5. The movement of the actuator rod 240 in FIG. 7 with respect to the arrangement in FIG. 5 is larger than that in FIG. 6.

As the actuator rod 240 moves upward in FIGS. 6 and 7, the connecting portion 230 moves upward in FIGS. 6 and 7 via the shaft portion 233. In this state, the connecting portion 230 is allowed to slightly rotate about the central axis of the shaft portion 233. In addition, in the plane perpendicular to the rotational axis direction of the compressor impeller 9, a gap is provided between the connecting portion 230 and the accommodation hole 112*e*. Accordingly, the connecting portion 230 is allowed to slightly move in the plane direction perpendicular to the rotational axis direction.

As described above, the link mechanism 200 includes the four-bar linkage. The connecting portion 230, the first movable portion 210, and the second movable portion 220 exhibit a one-degree-of-freedom behavior with respect to the first housing portion 110. Specifically, the connecting portion 230 slightly moves in the left-to-right direction, while slightly rotating counterclockwise in FIGS. 6 and 7 within the allowable range described above.

The rotational shaft 214 of the first movable portion 210 is supported by the first housing portion 110. The rotational shaft 214 is prevented from moving in the plane direction perpendicular to the rotational axis direction. The connecting shaft 213 is supported by the connecting portion 230. Since the connecting portion 230 is allowed to move, the connecting shaft 213 is movable in the plane direction perpendicular to the rotational axis direction. As a result, as the connecting portion 230 moves, the first movable portion 210 rotates around the rotational shaft 214 in a clockwise direction in FIGS. 6 and 7.

Similarly, the rotational shaft 224 of the second movable portion 220 is supported by the first housing portion 110. The rotational shaft 224 is prevented from moving in the plane direction perpendicular to the rotational axis direction. The connecting shaft 223 is supported by the connecting portion 230. Since the connecting portion 230 is allowed to move, the connecting shaft 223 is movable in the plane direction perpendicular to the rotational axis direction. As a result, as the connecting portion 230 moves, the second movable portion 220 rotates around the rotational shaft 224 in a clockwise direction in FIGS. 6 and 7.

As such, the first movable portion 210 and the second movable portion 220 move in directions being spaced apart from each other in the order of FIGS. 6 and 7. The protrusions 215 and 225 move to a position (retracted position) that is radially outward from the protruding position. In the retracted position, for example, the protrusions 215 and 225 are flush with the inner wall surface of the intake flow path 130, or are positioned radially outward from the inner wall surface of the intake flow path 130. When moving from the retracted position to the protruding position, the first movable portion 210 and second movable portion 220 approach and contact each other in the order of FIGS. 7, 6 and 5. As such, the first movable portion 210 and the second movable portion 220 are switched between the protruding position and the retracted position, depending on the rotational angle around the rotational shafts 214 and 224.

Thus, the first movable portion 210 and the second movable portion 220 are movable between the protruding position protruding into the intake flow path 130, and the retracted position not exposed (not protruding) into the intake flow path 130. In the present embodiment, the first movable portion 210 and the second movable portion 220 move in the radial direction of the compressor impeller 9. However, the first movable portion 210 and the second movable portion 220 are not limited thereto, and may rotate around the rotational axis of the compressor impeller 9 (circumferential direction) and move between the protruding position and the retracted position. For example, the first movable portion 210 and the second movable portion 220 may be shutter blades having two or more blades.

When the first movable portion 210 and the second movable portion 220 are in the retracted position (hereinafter referred to as a retracted position state), they do not protrude into the intake flow path 130. Therefore, a pressure loss of the intake air flowing in the intake flow path 130 is reduced.

As shown in FIG. 2, when the first movable portion 210 and the second movable portion 220 are in the protruding position (hereinafter referred to as a protruding position state), the protrusions 215 and 225 protrude into the intake flow path 130. In this state, the protrusions 215 and 225 are arranged within the intake flow path 130. When the protrusions 215 and 225 protrude into the intake flow path 130, a cross-sectional area of the intake flow path 130 decreases.

As a flow rate of air flowing into the compressor impeller 9 decreases, the air compressed by the compressor impeller 9 may flow backward in the intake flow path 130 (i.e., the air may flow from the downstream side to the upstream side). In other words, as the flow rate of air flowing into the compressor impeller 9 decreases, a backflow phenomenon called surging may occur.

In the protruding position state shown in FIG. 2, the protrusions 215 and 225 are located radially inside the outermost radial edge of the leading-edge LE of the compressor impeller 9. As a result, the air flowing backward in the intake flow path 130 is blocked by the protrusions 215 and 225. Therefore, the first movable portion 210 and the second movable portion 220 in the protruding position state can curb the backflow of the air in the intake flow path 130.

As the flow path cross-sectional area of the intake flow path 130 decreases, a flow velocity of the air entering the compressor impeller 9 increases. This reduces an angle of incidence to the blades of the compressor impeller 9, and stabilizes the air flow. As a result, the occurrence of surging in the centrifugal compressor CC can be curbed. In other words, the centrifugal compressor CC of the present embodiment can expand an operational range of the centrifugal compressor CC to a smaller flow rate area by protruding the protrusions 215 and 225 into the intake flow path 130.

As such, the first movable portion 210 and the second movable portion 220 are configured as throttling portions that narrow the intake flow path 130. In other words, in the present embodiment, the link mechanism 200 is configured as a throttling mechanism that narrows the intake flow path 130. The first movable portion 210 and the second movable portion 220 can change the cross-sectional area of the intake flow path 130 by operating the link mechanism 200.

Next, an engagement relationship between the connecting portion 230 and the actuator rod 240 in the link mechanism 200 is described in detail. First, an engagement relationship between a connecting portion 330 and an actuator rod 340 of a link mechanism 300 in a comparative example will be explained. Then, the engagement relationship between the connecting portion 230 and the actuator rod 240 of the link mechanism 200 in the present embodiment will be explained.

Figure 8:
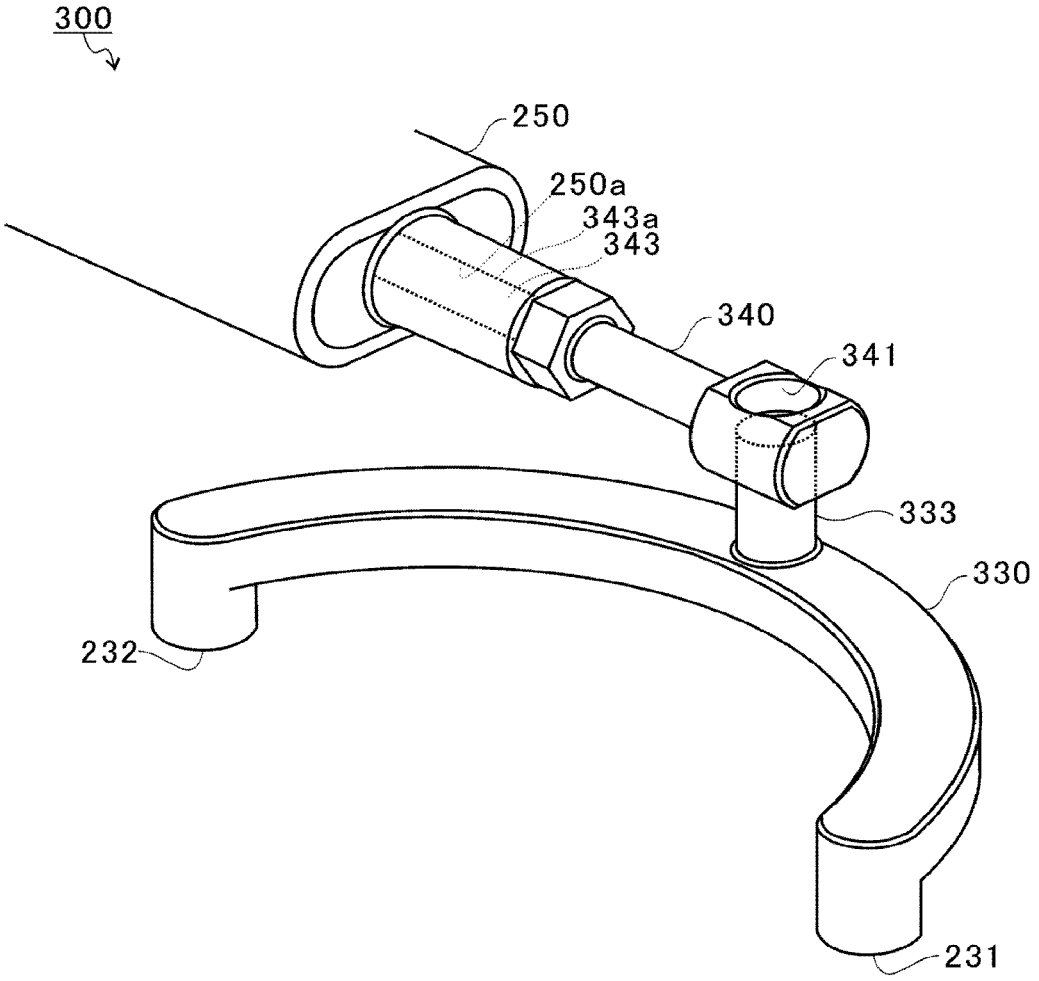
FIG. 8 is a schematic perspective view illustrating a configuration of a connecting portion and an actuator rod of a comparative example.

FIG. 8 is a schematic perspective view illustrating a configuration of the connecting portion 330 and the actuator rod 340 of the comparative example. Components that are substantially the same as those in the turbocharger TC of the above embodiment will be assigned with the same reference signs, and omitted from the descriptions. In the link mechanism 300 of the comparative example, shapes of the connecting portion 330 and the actuator rod 340 are different from those of the connecting portion 230 and the actuator rod 240 of the above embodiment. Other than that, configurations of the turbocharger TC are the same as those in the turbocharger TC of the above embodiment.

As shown in FIG. 8, the connecting portion 330 in the comparative example includes the first bearing hole 231, the second bearing hole 232, and a shaft portion 333. The comparative example is different from the above embodiment only in that the shape of the shaft portion 333 of the connecting portion 330 is different from the shape of the shaft portion 233 of the connecting portion 230. The shaft portion 333 has a substantially cylindrical shape. Note that a length in the central axis direction of the shaft portion 333 of the comparative example is equal to a length in the central axis direction of the shaft portion 233 of the above embodiment.

The actuator rod 340 in the comparative example includes a through hole 341 and a fastening portion 343. The through hole 341 passes through the actuator rod 340 in a radial direction. A shape of the through hole 341 in the cross-section perpendicular to a central axis thereof is substantially circular. The fastening portion 343 is connected to the actuator 250. The fastening portion 343 includes, for example, a male thread 343*a*. The female thread 250*a* is formed in the actuator 250, for example. The female thread 250*a* of the actuator 250 is fastened to the male thread 343*a* of the fastening portion 343. The male thread 343*a* of the fastening portion 343*a* is screwed into the female thread 250*a* of the actuator 250 to attach the actuator rod 340 to the actuator 250.

As shown in FIG. 8, the shaft portion 333 of the connecting portion 330 is inserted into the through hole 341 of the actuator rod 340. Accordingly, when the actuator 250 drives the actuator rod 340, the actuator rod 340 moves in the central axis direction thereof, and the connecting portion 330 is moved in the central axis direction of the actuator rod 340. In this state, a pressing force is applied to the shaft portion 333 of the connecting portion 330 from the through hole 341 of the actuator rod 340.

Figure 9:
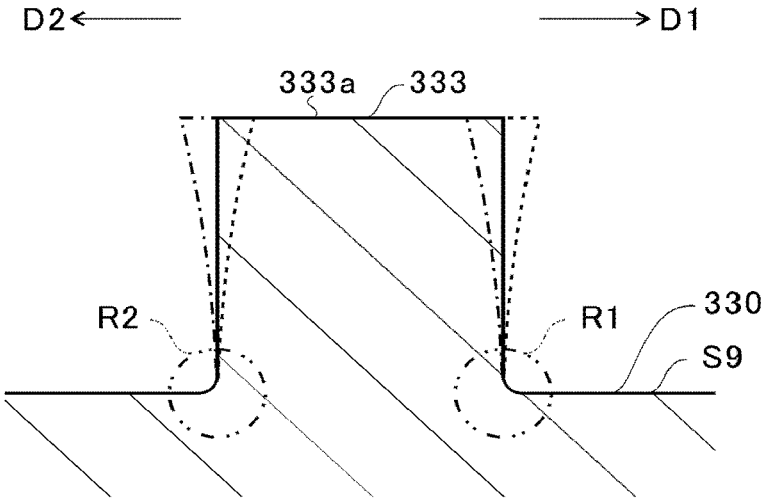
FIG. 9 is a schematic cross-sectional view of a shaft portion of the connecting portion.

FIG. 9 is a schematic cross-sectional view of the shaft portion 333 of the connecting portion 330. In FIG. 9, D1 is a first direction in which the actuator rod 340 presses the shaft portion 333. In FIG. 9, D2 is a second direction in which the actuator rod 340 presses the shaft portion 333. The first direction D1 and the second direction D2 correspond to the central axis direction of the actuator rod 340. The first direction D1 is opposite to the second direction D2.

As shown in FIG. 9, when the shaft portion 333 is pressed by the actuator rod 340 in the first direction D1, the shaft portion 333 is slightly deformed in the first direction D1. When the shaft portion 333 is pressed by the actuator rod 340 in the second direction D2, the shaft portion 333 is slightly deformed in the second direction D2.

In this state, stress concentrations occur at boundaries R1 and R2 between the intake upstream surface S9 and the shaft portion 333 of the connecting shaft 330 shown by dashed-two dotted lines in FIG. 9. In other words, the stress concentrations occur at two locations (boundaries R1 and R2) on a side facing the first direction D1 and on a side facing the second direction D2 of the shaft portion 333. The stress concentrations occurring at the boundaries R1 and R2 may cause a decrease in durability of the connecting portion 330.

Furthermore, as explained in FIG. 8, the actuator rod 340 is attached to the actuator 250 by screwing the male thread 343*a* into the female thread 250*a*. However, when the actuator rod 340 rotates, the central axis of the through hole 341 deviates from the central axis of the shaft portion 333. If the central axis of the through hole 341 is not substantially aligned with the central axis of the shaft portion 333, the shaft portion 333 cannot be inserted into the through hole 341. Therefore, an operator is required to attach the actuator rod 340 to the actuator 250 so that the central axes of the through hole 341 and the shaft portion 333 are substantially aligned with each other. This makes the assembly of the link mechanism 300 complicated.

Figure 10:
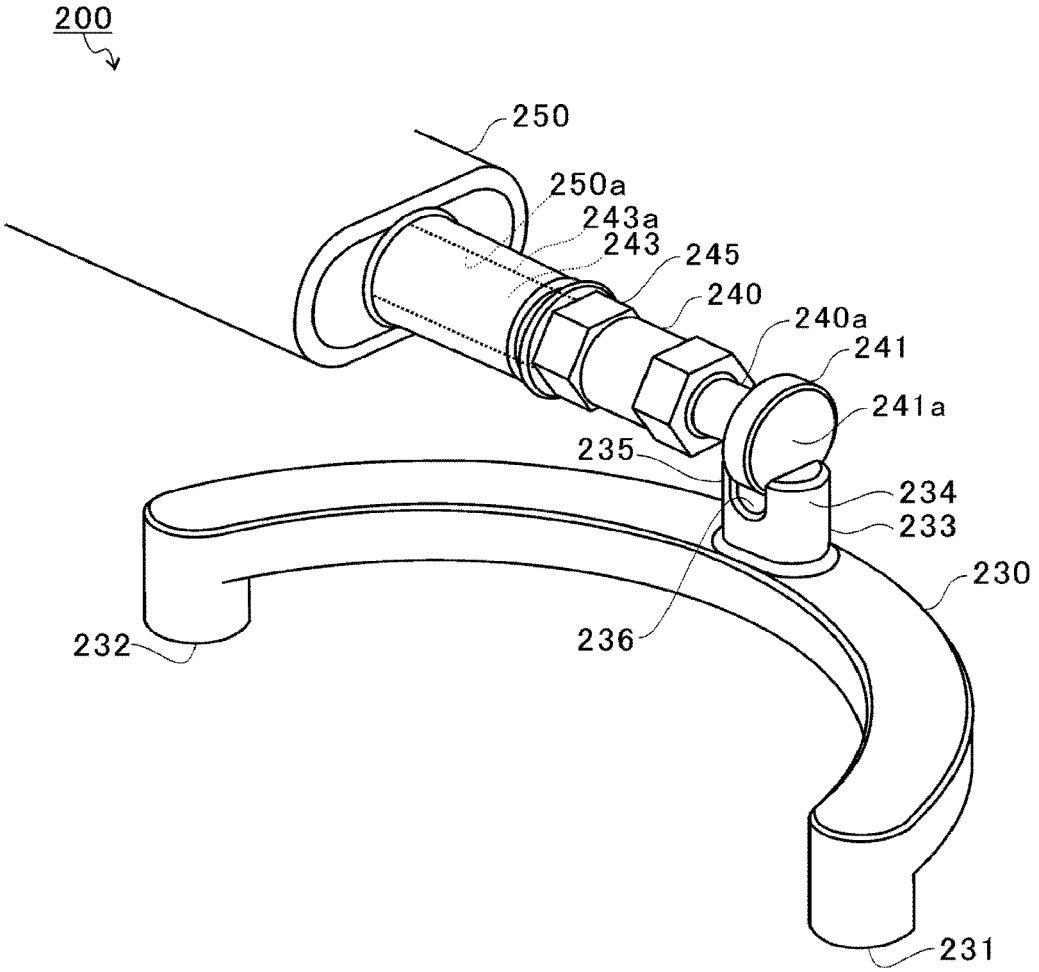
FIG. 10 is a schematic perspective view illustrating a configuration of a connecting portion and an actuator rod of the present embodiment.

FIG. 10 is a schematic perspective view illustrating a configuration of the connecting portion 230 and the actuator rod 240 of the present embodiment. As shown in FIG. 10, the connecting portion 230 of the present embodiment includes a shaft portion 233 that is different from the shaft portion 333 of the comparative example. Furthermore, the actuator rod 240 of the present embodiment has a shape (plate portion 241) that is different from the actuator rod 340 of the comparative example.

The shaft portion 233 includes a pair of projections 234 and 235. The pair of projections 234 and 235 are arranged so as to face to each other across the plate portion 241 in the central axis direction of the actuator rod 240. A groove 236 is formed between the pair of projections 234 and 235.

The actuator rod 240 of the present embodiment includes the plate portion 241 and the fastening portion 243. The actuator rod 240 of the present embodiment does not have the through hole 341 of the comparative example, and includes the plate portion 241 instead of the through hole 341. The plate portion 241 includes the plane 241*a* at the end. The plate portion 241 is connected to a shaft portion 240*a* of the actuator rod 240 at a side opposite to the plane 241*a*. The plate portion 241 is arranged between the pair of projections 234 and 235 and engages with the groove 236.

The plate portion 241 contains a material that is harder than a material of areas other than the plate portion 241 in the actuator rod 240. For example, in the actuator rod 240 of the present embodiment, only the plate portion 241 is subjected to electroless nickel plating. However, the plate portion 241 is not limited thereto, and may be formed as a separate component from the actuator rod 240, and may be attached to the actuator rod 240. In such a case, the plate portion 241 is made from a material that is harder than a material of the actuator rod 240. This improves wear resistance of the plate portion 241 compared to when the plate portion 241 is made from the same material as that of the actuator rod 240.

The male thread 243*a* is formed in the fastening portion 243, and the female thread 250*a* is formed in the actuator 250. By screwing the male thread 243*a* of the fastening portion 243 into the female thread 250*a* of the actuator 250, the actuator rod 240 is attached to the actuator 250. A nut 245 is also screwed on the male thread 243*a*. The nut 245 includes an unshown female thread, and the unshown female thread is engaged with the male thread 243*a*. The nut 245 can be rotated around the central axis of the actuator rod 240 to move in the central axis direction of the actuator rod 240 within a range where the male thread 243*a* is formed. As the nut 245 moves toward the actuator 250, the nut 245 contact the actuator 250. When the nut 245 is tightened toward the actuator 250 in this state, a movement of the actuator rod 240 relative to the actuator 250 is prevented. As such, the actuator rod 240 is attached to the actuator 250 by a so-called double nut. This allows easy adjustment of a length of the actuator rod 240 from the actuator 250 to the end (plate portion 241).

As shown in FIG. 10, the plate portion 241 of the connecting portion 230 is inserted into the groove 236 of the shaft portion 233. Accordingly, when the actuator 250 moves the actuator rod 240, the actuator rod 240 moves in the central axis direction thereof, and the connecting portion 230 is moved in the central axis direction of the actuator rod 240. In this state, a pressing force is applied to the shaft portion 233 of the connecting portion 230 from the plate portion 241 of the actuator rod 240.

Figure 11:
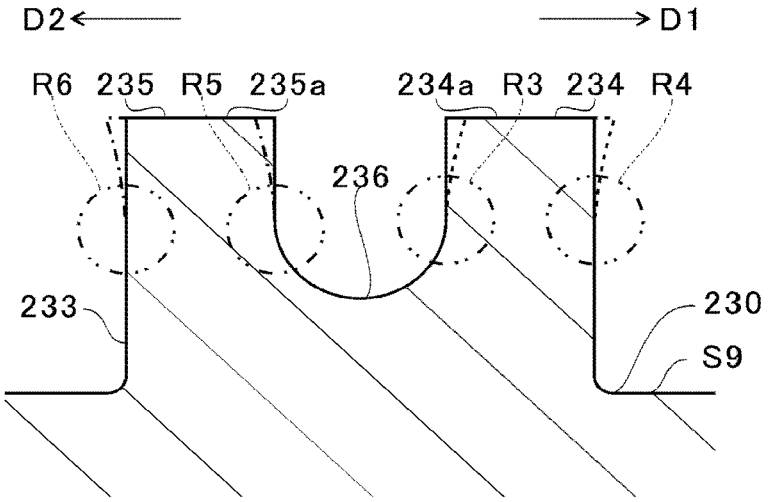
FIG. 11 is a schematic cross-sectional view of a shaft portion of the connecting portion.

FIG. 11 is a schematic cross-sectional view of the shaft portion 233 of the connecting portion 230. In FIG. 11, a cross-section including the central axis of the shaft portion 233 is shown. In FIG. 11, D1 is the first direction in which the actuator rod 240 presses the shaft portion 233. In FIG. 11, D2 is the second direction in which the actuator rod 240 presses the shaft portion 233. The first direction D1 and the second direction D2 correspond to the central axis directions of the actuator rod 240. The first direction D1 is opposite to the second direction D2.

As shown in FIG. 11, the groove 236 has a U-shape in a cross section along a direction in which the pair of projections 234 and 235 235 are arranged (axial direction of the actuator rod 240). Projecting heights of side surfaces closer to each other in the pair of projections 234 and 235 are lower than projecting heights of side surfaces spaced apart from each other in the pair of projections 234 and 235. Specifically, distances from ends 234*a* and 235*a* of the pair of projections 234 and 235 to a bottom of the groove 236 are smaller than distances from the ends 234*a* and 235*a* of the pair of projections 234 and 235 to the intake upstream surface S9. In other words, the groove 236 formed between the pair of projections 234 and 235 is located closer to the actuator rod 240 with respect to the intake upstream surface S9 of the connecting portion 230. In still other words, the distances from the ends 234*a* and 235*a* of the pair of projections 234 and 235 to the bottom of the groove 236 (i.e., the depth of groove 236) is smaller than distances from the ends 234*a* and 235*a* to bases of the pair of projections 234 and 235.

When the shaft portion 233 is pressed in the first direction D1 by the actuator rod 240, the projection 234 facing the first direction D1 of the pair of projections 234 and 235 is slightly deformed in the first direction D1 as shown by dashed lines in FIG. 11. In this state, a stress concentration occurs at a boundary R3 between the projection 234 and the bottom of the groove 236 shown by dashed-two dotted lines in FIG. 11. In contrast, a side surface R4 opposite to the boundary R3 in the projection 234 is not a boundary between the projection 234 and the intake upstream surface S9 of the connecting portion 230, and is substantially flat. Accordingly, there is almost no stress concentration in the side surface R4 compared to the boundary R3.

When the shaft portion 233 is pressed in the second direction D2 by the actuator rod 240, the protrusion 235 facing the second direction D2 of the pair of projections 234 and 235 is slightly deformed in the second direction D2 as shown by the dashed-dotted lines in FIG. 11. In this state, a stress concentration occurs at a boundary R5 between the protrusion 235 and the bottom of the groove 236 shown by dashed-two dotted lines in FIG. 11. In contrast, a side surface R6 opposite to the boundary R5 in the protrusion 235 is not a boundary between the protrusion 235 and the intake upstream surface S9 of the connecting portion 230, and is substantially flat. Accordingly, there is almost no stress concentration in the side surface R6 compared to the boundary R5.

As such, when the shaft portion 233 is pressed by the actuator rod 240 in the first direction D1, no stress is applied to the protrusion 235 and no stress concentration occurs at the boundary R5. In contrast, when the shaft portion 233 is pressed by the actuator rod 240 in the second direction D2, no stress is applied to the projection 234 and no stress concentration occurs at the boundary R3. Furthermore, the bottom of the groove 236 is formed in a U-shape, and the stress concentration at the boundaries R3 and R5 is less likely to occur.

Therefore, according to the present embodiment, the stress concentration on the shaft portion 233 (boundary R3 or boundary R5) can be smaller than the stress concentration on the shaft portion 333 (boundary R1 or boundary R2) in the comparison example.

As shown in FIG. 10, the plate portion 241 is located at the end of the shaft portion 240*a* of the actuator rod 240. When the actuator rod 240 presses the shaft portion 233, a stress concentration occurs at a boundary between the plate portion 241 and the shaft portion 240*a*. However, almost no stress concentration occurs on the plane 241*a* of the plate portion 241. If the plate portion 241 is located in the middle of the shaft portion 240*a* of the actuator rod 240, two boundaries are formed between the plate portion 241 and the shaft portion 240*a* on both sides in the central axis direction of the actuator rod 240. In this case, when the actuator rod 240 presses the shaft portion 233, stress concentrations occur at the two boundaries. Therefore, when the plate portion 241 is located at the end of the shaft portion 240*a* of the actuator rod 240, the stress concentration occurring at the plate portion 241 can be reduced, compared to when the plate portion 241 is located in the middle of the shaft portion 240*a*.

In addition, in the present embodiment, the distances from the ends 234*a* and 235*a* of the pair of projections 234 and 235 to the boundaries R3 and R5 are shorter than distances from an end 333*a* of the shaft portion 333 to the boundaries R1 and R2 in the comparative example. Therefore, stress concentration points (boundaries R3 and R5) on the pair of projections 234 and 235 can be closer to a pressing point by the actuator rod 240, compared to stress concentration points (boundaries R1 and R2) on the shaft portions 333. As a result, the stress concentrations on the projections 234 and 235 can be smaller than those on the shaft portion 333 in the comparative example.

As described above, the link mechanism 200 of the present embodiment includes the actuator rod 240 with the plate portion 241, and the connecting portion 230 with the pair of projections 234 and 235. The plate portion 241 is positioned between the pair of projections 234 and 235. This can curb the stress concentrations occurring at the boundaries R3 and R5 on the pair of projections 234 and 235. As a result, the decrease in durability of the connecting portion 230 can be prevented.

Furthermore, as explained in FIG. 10, the actuator rod 240 is attached to the actuator 250 by screwing the male thread

243*a* into the female thread 250*a*. However, since the plate portion 241 is formed in a substantially cylindrical shape, the plate portion 241 can engage with the groove 236 of the shaft portion 233 at any phases around the central axis of the actuator rod 240. Therefore, the operator can engage the plate portion 241 and the groove 236 without considering the rotational phase of the actuator rod 240. As a result, the assembly of the link mechanism 200 can be simplified.

Although the embodiment of the present disclosure has been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

In the above embodiment, the example is explained in which the distances from the ends 234*a* and 235*a* of the pair of projections 234 and 235 to the bottom of the groove 236 are smaller than the distances from the ends 234*a* and 235*a* of the pair of projections 234 and 235 to the intake upstream surface S9. However, the distances from the ends 234*a* and 235*a* of the pair of projections 234 and 235 to the bottom of the groove 236 are not limited thereto, and may be equal to the distances from the ends 234*a* and 235*a* of the pair of projections 234 and 235 to the intake upstream surface S9.

In the above embodiment, the example is explained in which the bottom surface of groove 236 is U-shaped. However, the bottom surface of groove 236 is not limited thereto, and may be rounded or rectangular.

In the above embodiment, the example is explained in which the plate portion 241 is substantially cylindrical. However, the plate portion 241 is not limited thereto, and may be, for example, a rectangular or polygonal column.

In the above embodiment, the example is explained in which the plate portion 241 contains a material that is harder than a material of areas other than the plate portion 241 in the actuator rod 240. However, the plate portion 241 is not limited thereto, and may be made from the same material as a material of the actuator rod 240.

In the above embodiment, the example is explained in which the nut 245 is provided on the actuator rod 240. However, the actuator rod 240 is not limited thereto, and may not be provided with the nut 245.

What is claimed is:

1. A centrifugal compressor comprising:

an impeller provided in a housing;

a throttling portion provided in front of the impeller in the housing;

an actuator rod connected to an actuator and including a plate portion including a plane at its end; and a connecting portion connected to the throttling portion and including a pair of projections facing each other across the plate portion in an axial direction of the actuator rod.

2. The centrifugal compressor according to claim 1, wherein projecting heights of side surfaces closer to each other of the pair of projections are lower than projecting heights of side surfaces spaced apart from each other of the pair of projections.

3. The centrifugal compressor according to claim 1, wherein a groove having a U-shape in a cross-section along the axial direction of the actuator rod is provided between the pair of projections.

4. The centrifugal compressor according to claim 1, wherein the plate portion has a circular shape in a cross-section perpendicular to the axial direction of the actuator rod.

5. The centrifugal compressor according to claim 1, wherein the plate portion contains a material that is harder than a material of areas other than the plate portion in the actuator rod.

6. The centrifugal compressor according to claim 1, wherein the actuator rod is attached to the actuator by double nuts.

* * * * *